US005984325A

United States Patent [19]

Acuna

[11] Patent Number: 5,984,325

[45] **Date of Patent: *Nov. 16, 1999**

[54] ANGULARLY ADJUSTABLE SNOWBOARD BOOT BINDING

[76] Inventor: Peter R. Acuna, 1613 Chelsea Rd., Suite 311, San Marino, Calif. 91108

[ * ] Notice: This patent is subject to a terminal disclaimer.

[21] Appl. No.: 08/920,807

[22] Filed: Aug. 29, 1997

Related U.S. Application Data

[63] Continuation-in-part of application No. 08/566,942, Dec. 4, 1995.

[51] Int. Cl.[6] ..... B62B 9/04; A63C 5/00

[52] U.S. Cl. ..... 280/14.2; 280/607

[58] Field of Search ..... 280/607, 617, 280/618, 626, 629, 633, 634, 14.2

[56] References Cited

U.S. PATENT DOCUMENTS 5,499,837 3/1996 Hale et al. .
5,505,478 4/1996 Napoliello .
5,584,492 12/1996 Fardie .
5,586,779 12/1996 Dawes et al. .

*Primary Examiner*—Lanna Mai
*Assistant Examiner*—Faye M. Fleming
*Attorney, Agent, or Firm*—Sheldon & Mak; Denton L. Anderson

[57] ABSTRACT

An adjustable snowboard boot binding comprising a base disc, a main body, a top disc and one or more levers. The base disc is mounted to the top of a snowboard. The main body is sandwiched between the top disc and the base disc. The lever is hand-manipulable, allowing the snowboarder to adjust the angle of the boot binding with respect to the longitudinal axis of the snowboard without the need for tools. With the lever in the open position, the main body of the boot binding is free to rotate about an axis normal to the snowboard. With the lever in the closed position, the main body is rigid, allowing the snowboarder to maneuver the snowboard when riding.

14 Claims, 7 Drawing Sheets

ANGULARLY ADJUSTABLE SNOWBOARD BOOT BINDING

CONTINUATION-IN-PART APPLICATION

This is a continuation-in-part of application Ser. No. 08/566,942, filed Dec. 04, 1995, which is presently pending.

BACKGROUND OF THE INVENTION

This invention relates, generally, to a snowboard boot binding. More particularly, it relates to a snowboard boot binding that can be adjusted angularly both quickly and easily without the need for a tool, and can be adjusted while the rider's boot is still in the binding.

The sport of snowboarding has been practiced now for numerous years and has gained tremendous popularity across the country and throughout the world. As with skiing, a snowboarder wears snowboarding boots that are firmly held into boot bindings. The bindings are rigidly attached to the board to allow the user to properly maneuver the board when riding. Unlike conventional skiing, however, the snowboarder places both feet onto a single board, one in front of the other, and stands at an angle to the direction of travel.

A snowboarder will often desire to change the angle of the front and/or back foot with respect to the longitudinal axis of the board. Different angular foot positions are desired for speed, slalom, free-style or acrobatics. Depending on the snow or weather conditions, the person's skill level, or the particular attitude of a given snowboarder, the position of each foot can change numerous times during a single outing.

In the case of a skateboard or surfboard, changing foot positions is easy-just pick up a foot and move it. With a snowboard, however, the rider's feet are rigidly mounted into the bindings, preventing any such movement.

SUMMARY OF THE INVENTION

It is an object of this invention to provide a snowboard boot binding that can be angularly adjusted by the rider both quickly and easily. It is a further object of this invention to provide a snowboard boot binding that can be angularly adjusted by the rider while the rider's foot remains in the binding.

In order to perform these functions and to overcome the above problems, the invention incorporates a boot binding with a main body that is engaged from below by a base disc and from above by a top disc. The two discs are substantially circular and share a common centerline about which the main body can rotate. The base disk is rigidly mounted to the top surface of a snowboard with screws or other fastening means. The boot binding main body is designed to rotate about an axis normal to the surface of the snowboard, while remaining rigid about all other axes and in all directions. The boot binding main body is locked into a selected angular position using one or more hand-manipulated levers oriented around the perimeter of the main body.

In the preferred embodiment, the top disc, main body and base disc are fabricated from rigid plastic, and the fasteners fabricated from metal. However, other materials with similar properties can be substituted to vary the apparatus' weight, strength, flexibility or other characteristics.

In a first embodiment of the invention, a lever is positioned on the side of the boot binding main body. The invention can be built with one or more side levers. Where two side levers are used, the two are preferably positioned opposite each other, one on each side of the boot binding main body; however, the two may be positioned at any orientation around the perimeter of the binding. Attached to each side lever is a horizontal shaft passing through a channel in the boot binding main body. The shaft terminates in an orifice in either the top disc or the base disc.

When the lever is rotated into the open position, the shaft is drawn out of the rigidly-mounted, central disc. This allows the boot binding main body to rotate freely. After the rider rotates the binding into the desired angular position, the side lever is rotated into the closed position. In the closed position, the shaft is moved into one of a number of orifices in the central disc, preventing the boot binding main body from rotating out of the desired position.

In a second embodiment, the center disc comprises a continuous ring of gear teeth about its perimeter. Instead of a shaft engaging an orifice, a toothed block engages the gear teeth. The block is engaged and disengaged by the rotation of a cam positioned within a bore in the block. To unlock the apparatus, the cam is rotated against the outermost surface of the bore, sliding the block away from the gear. To lock the apparatus, the cam is rotated against the innermost surface of the bore, sliding the block, and the locking teeth on the block, against the gear. To aid in locking, the apparatus may comprise a spring mechanism tending to force the block in the locked position.

DESCRIPTION OF THE PREFERRED EMBODIMENTS

Figure 1:
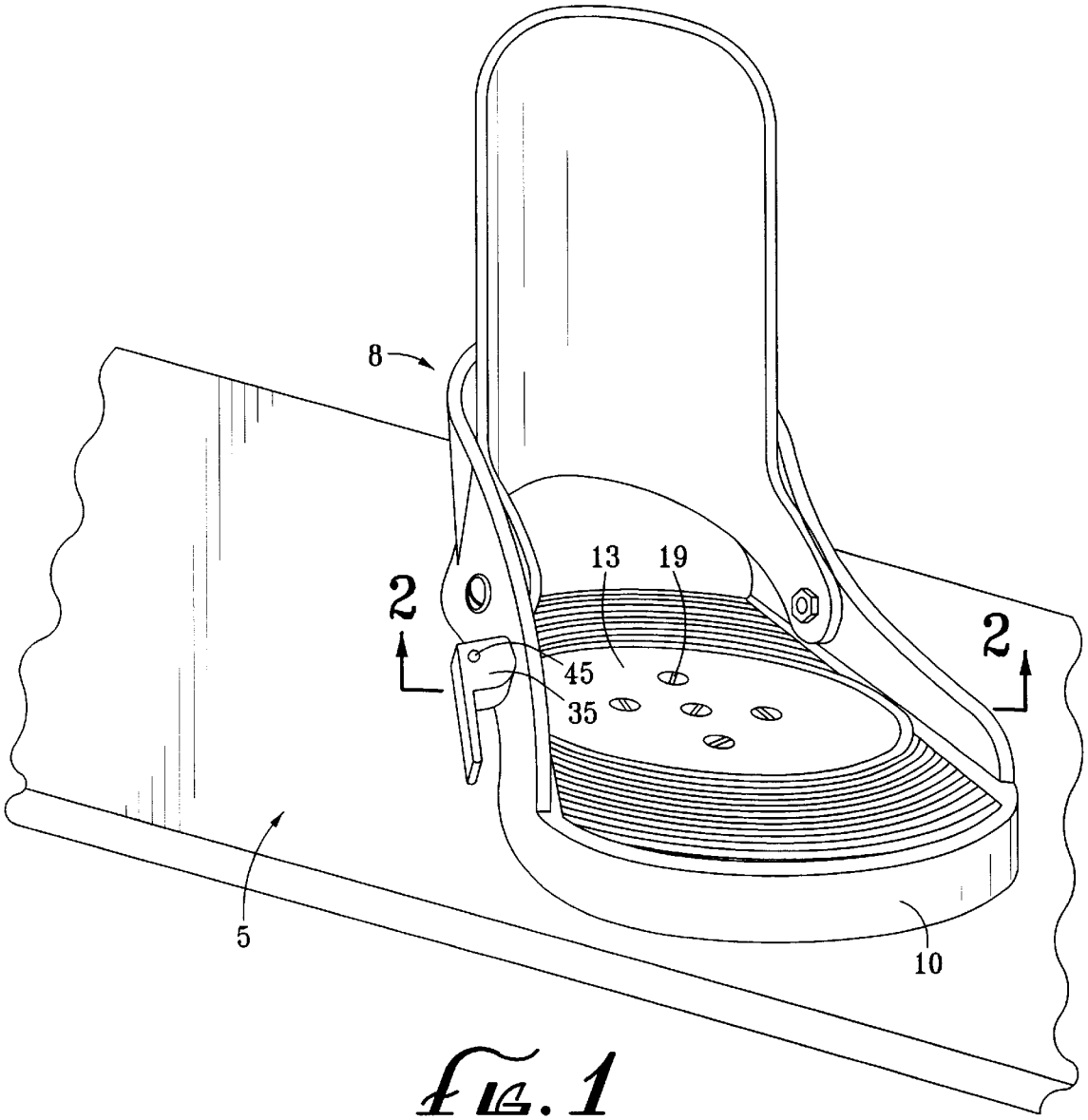
FIG. 1 is a perspective view of a portion of a snowboard in combination with an angularly adjustable snowboard boot binding according to a first embodiment of the present invention.
Figure 2:
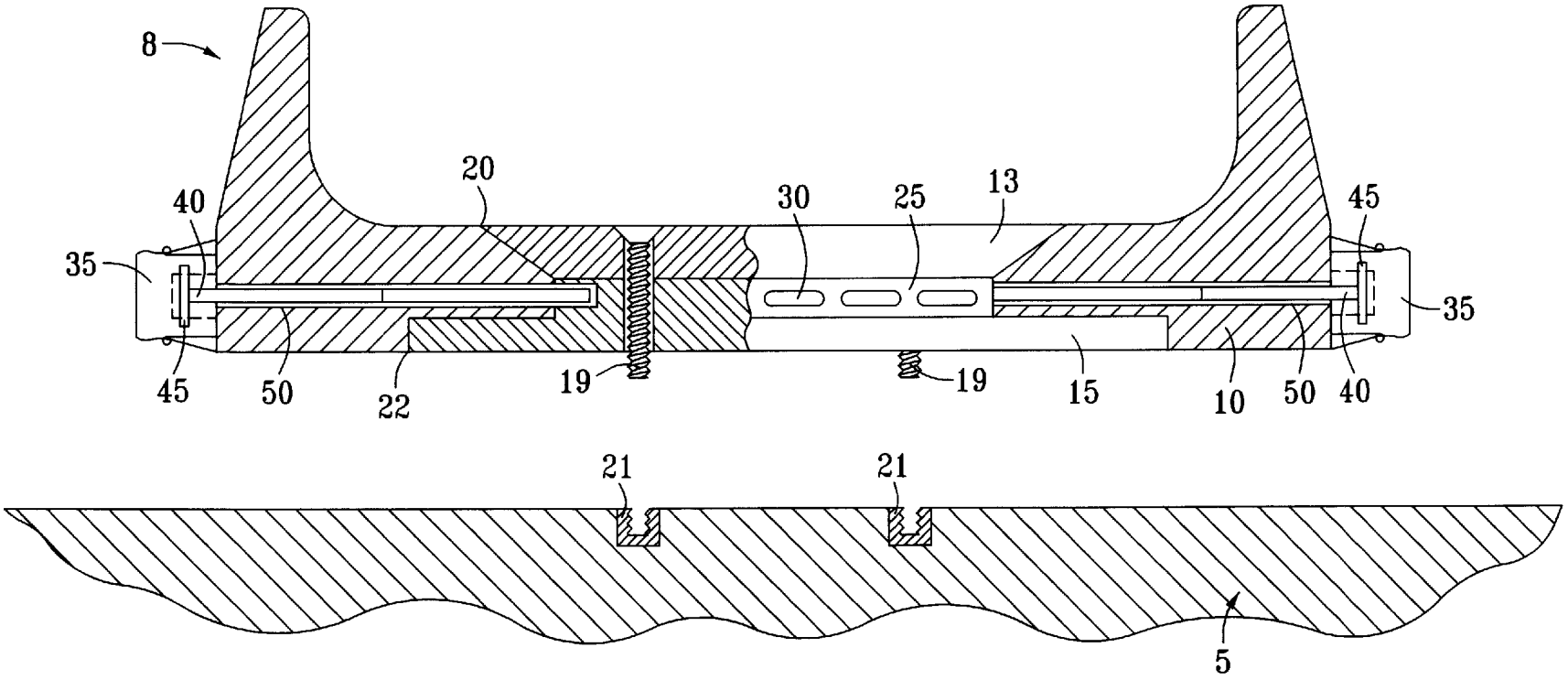
FIG. 2 is an elevation view of the cross-section A—A as defined in FIG. 1.
Figure 3:
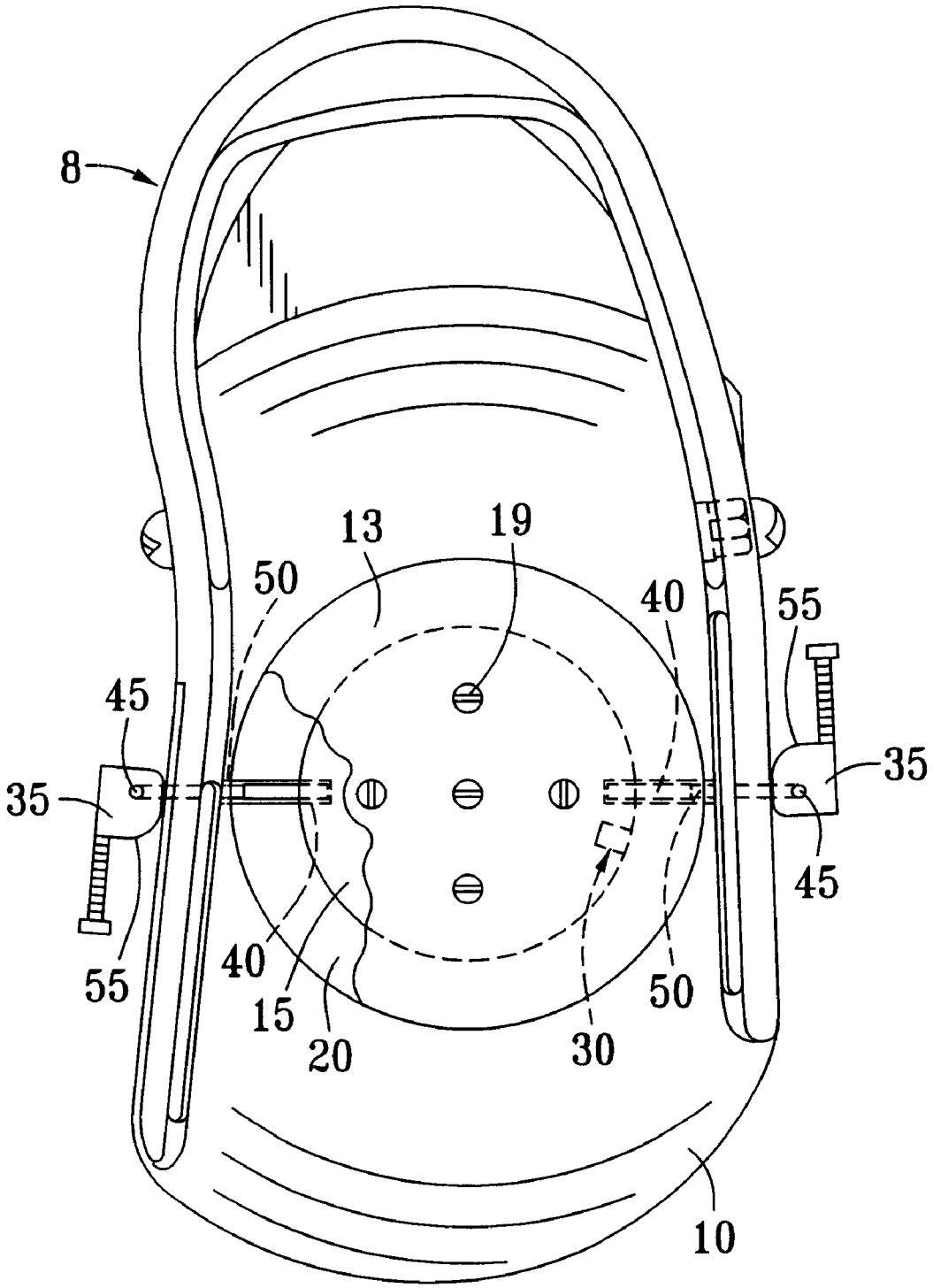
FIG. 3 is a plan view of a first embodiment of the present invention containing a cutaway section.
Figure 4:
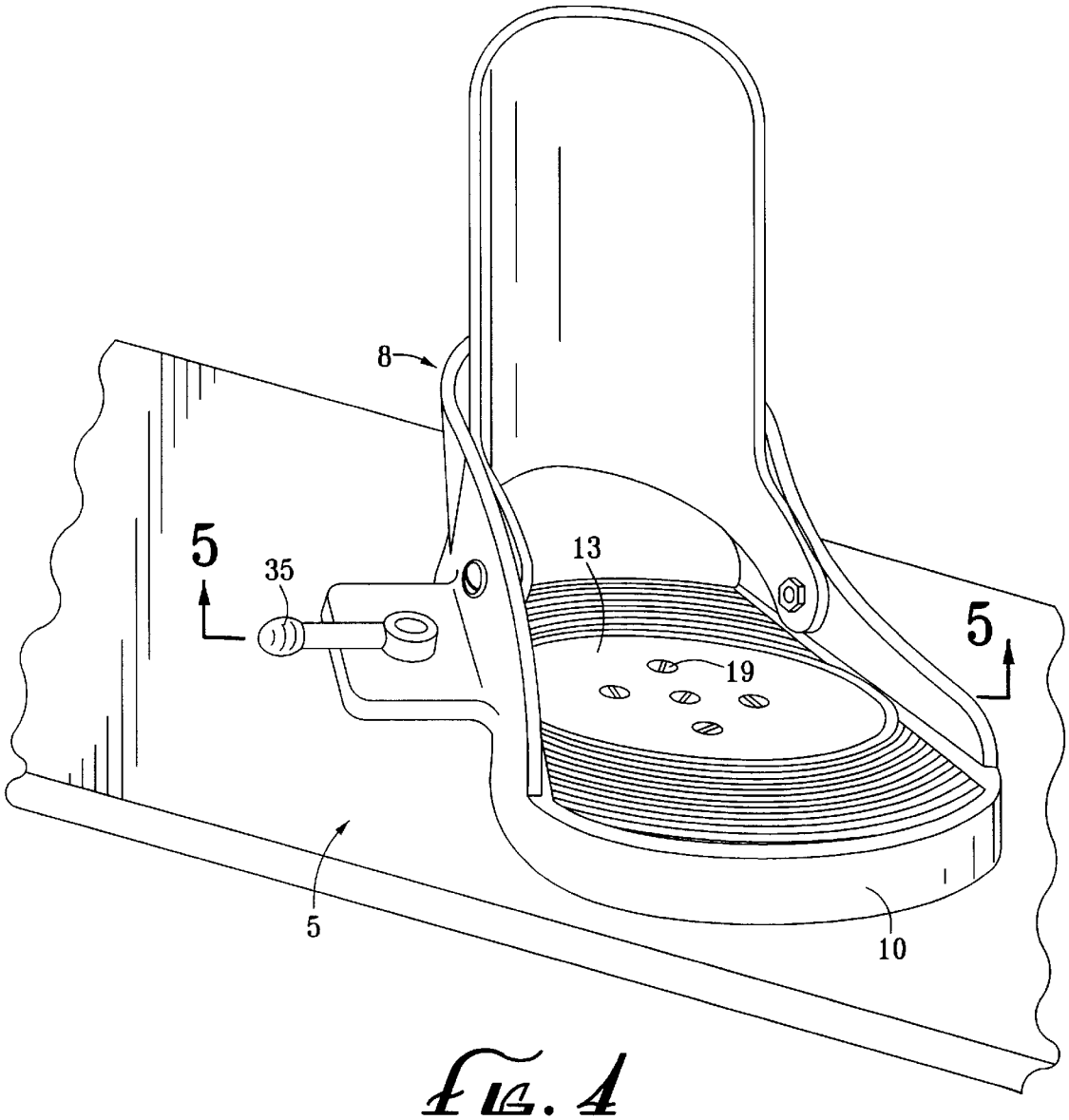
FIG. 4 is a perspective view of a portion of a snowboard in combination with an angularly adjustable snowboard boot binding according to a second embodiment of the present invention.
Figure 5:
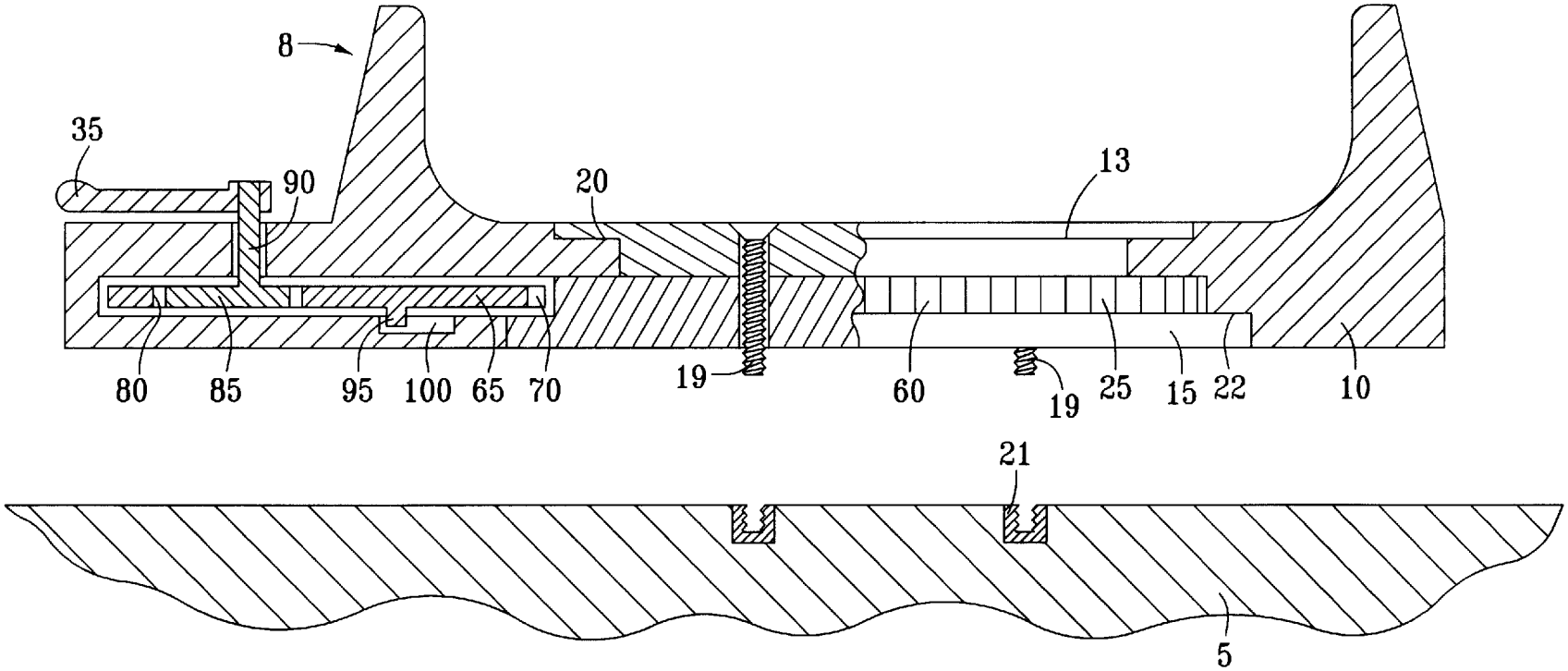
FIG. 5 is an elevation view of the cross-section B—B as defined in FIG. 4.
Figure 6:
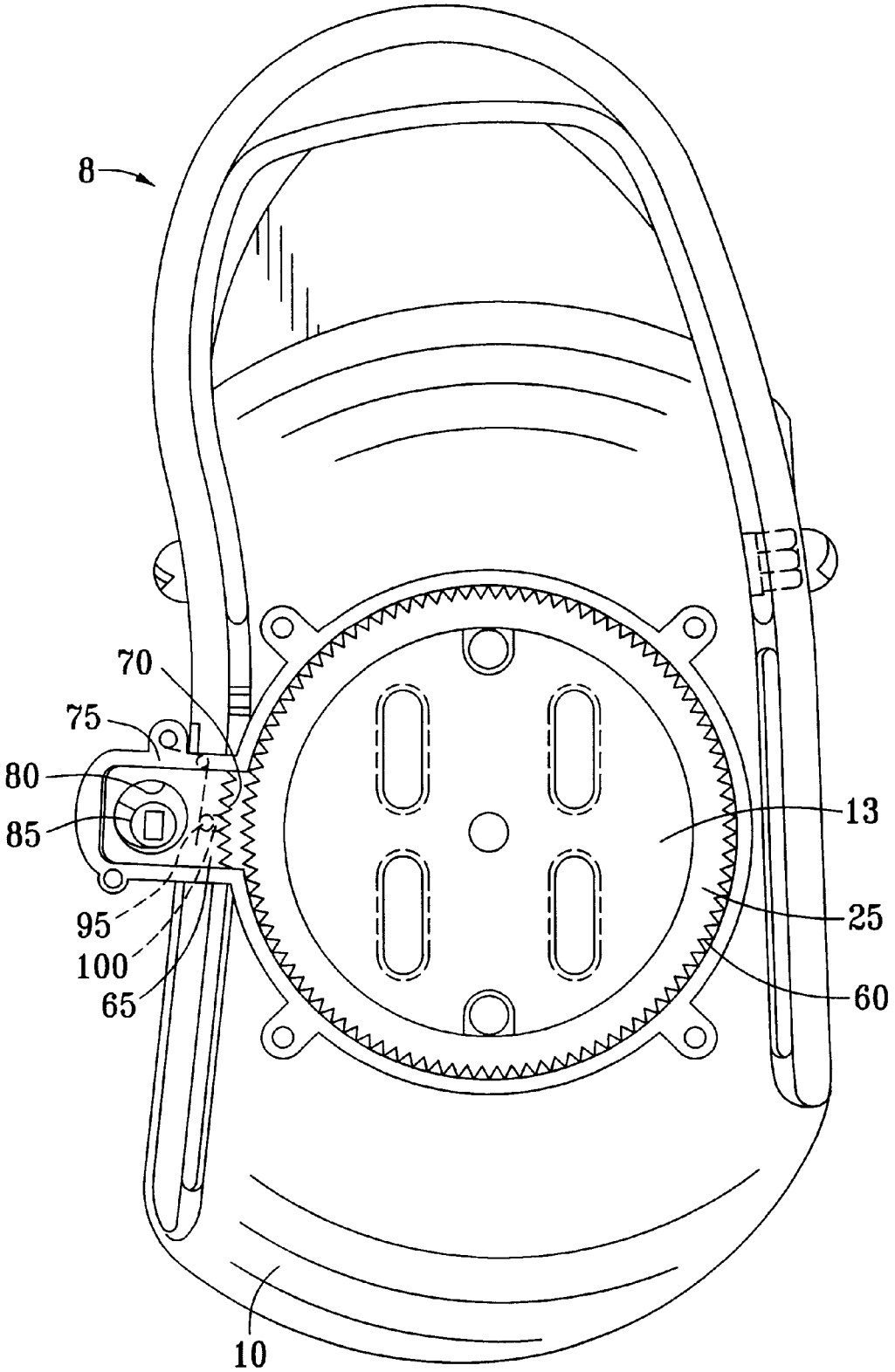
FIG. 6 is a plan view of a second embodiment of the present invention with the cover plate removed to allow for viewing the critical elements.

FIGS. 1–3 show a portion of a snowboard 5 in combination with a boot binding 8 according to a first embodiment of the present invention. The main body 10 of boot binding 8 is engaged from above by top disc 13 and from below by base disc 15. Top disc 13 engages main body 10 at a substantially circular upper cavity 20. Base disc 15 engages main body 10 at a substantially circular lower cavity 22. The centerline of upper cavity 20 is collinear with the centerline of lower cavity 22. The contacting surfaces between top disc 13 and main body 10, and between main body 10 and base disc 15 are smooth, allowing main body 10 to rotate freely about an axis normal to the plane of snowboard 5.

Top disc 13 and base disc 15 are rigidly mounted to snowboard 5 with one or more screws 19, or similar fasteners, engaged with inserts 21 in snowboard 5. Main body 10 is held between top disc 13 and base disc 15, preventing movement of main body 10 in all directions except about the axis through the centerlines of the discs and cavities. In its operating position, the top surface of top disc 13 is flush with the top surface of main body 10 and the lower surface of base disc 15 is flush with the bottom surface of main body 10.

Base disc 15 has a raised central disc 25 with a centerline collinear with the centerline of base disc 15. Central disc 25 has a plurality of orifices 30 extending in a radical direction inward from the perimeter toward its center. Each orifice 30 is approximately ⅛"–¾", and is of a constant cross-sectional shape, preferably circular or oval.

A side lever 35 is attached to the side of main body 10. Side lever 35 is positioned approximately half the distance between the heel and the toe of boot binding 8, on the outside edge of main body 10. In the preferred embodiment, side lever 35 is positioned on each side of main body 10. Each side lever 35 can be independently rotated over an angle of approximately ninety degrees (90°) from an open position to a closed position.

Side lever 35 is attached to a horizontal shaft 40 by a hinged coupling 45. Hinged coupling 45 allows side lever 35 to rotate about an axis perpendicular to horizontal shaft 40. Horizontal shaft 40 passes through a horizontal first channel 50 in main body 10. First channel 50 runs in a radial direction along a line drawn from the point of contact of side lever 35 with main body 10 to the center of base disc 15.

When side lever 35 is in the closed position, the end of horizontal shaft 40 opposite hinged coupling 45 terminates inside orifice 30. Horizontal shaft 40 has a cross-section complementary to the cross-section of first channel 50. Depending on the orientation of main body 10 selected by the snowboarder, one of the plurality of orifices 30 will line up with channel 50. The interference of horizontal shaft 40 with first channel 50 and orifice 30 prevents main body 10 from rotating with respect to base disc 15 and, therefore, with respect to snowboard 5.

When side lever 35 is moved from the closed position to the open position, first cam 55 moves horizontal shaft 40 toward side lever 35, drawing horizontal shaft 40 entirely out of orifice 30. In this position, main body 10 is free to rotate about an axis normal to snowboard 5. Once the snowboarder has selected an orientation for main body 10, side levers 35 can be moved back into the closed position, preventing main body 10 from rotating.

FIGS. 4–8 show an angularly adjustable snowboard boot binding according to a second embodiment of the present invention. In this embodiment, central disc 25 comprises a plurality of gear teeth 60 along its perimeter instead of the orifices 30 shown in the first embodiment. Central disc 25 comprises approximately ninety (90) gear teeth 60. This allows the apparatus to be adjusted in four degree increments. It is understood that the apparatus can contain more or fewer teeth to allow for different adjustment accuracy.

Gear teeth 60 are engaged by block 65 which comprises a plurality of complementary locking teeth 70. Locking teeth 70 are oriented in an arcuate path complementary to central disc 25, allowing locking teeth 70 to fully engage with gear teeth 60. In the preferred embodiment, block 65 comprises between four and six locking teeth 70, inclusive.

Block 65 is substantially rectilinear and lies within second channel 75. Second channel 75 is slightly wider and approximately one-half inch longer than block 65, allowing block 65 to slidably engage and disengage from gear teeth 60.

Figure 7A:
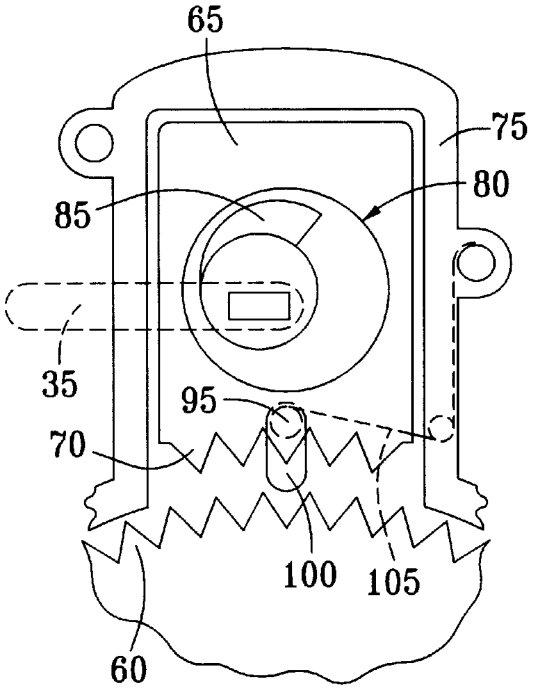
FIG. 7 (*a*)–(*c*) are plan views showing the operation of the cam and gear elements of a second embodiment of the present invention.
Figure 7B:
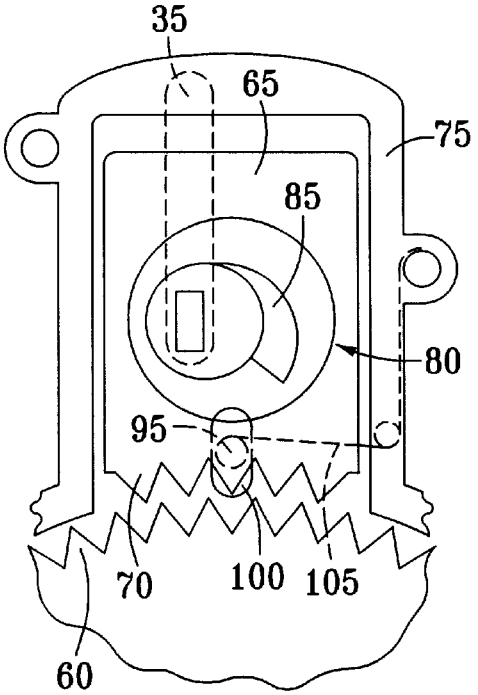
Figure 7C:
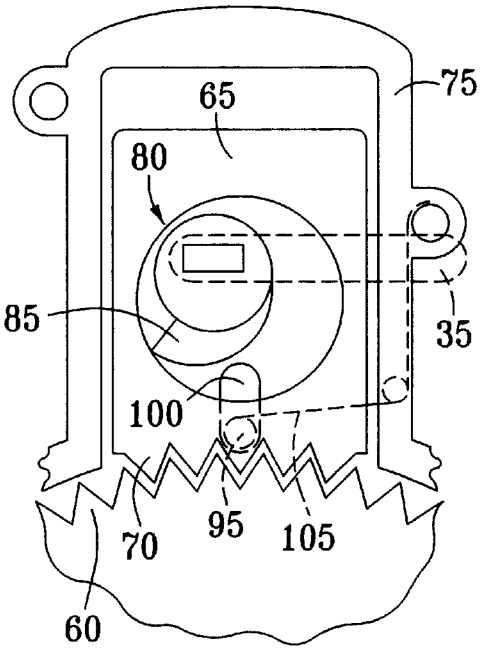
Figure 8:
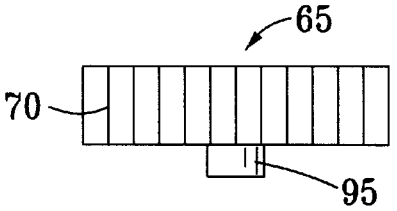
FIG. 8 is an elevation view of the locking member in a second embodiment of the present invention.

Block 65 comprises a cylindrical bore 80 through its entire thickness from top to bottom, as defined when the apparatus is oriented for use. Bore 80 is a right cylinder approximately one inch (1") in diameter. Within bore 80 lies second cam 85 which is rigidly connected to side lever 35 by vertical shaft 90. Second cam 85 has a maximum diameter slightly less than the diameter of bore 80, allowing it to rotate freely therein. One hundred eighty degrees (180°) of rotation in second cam 85 causes block 65 to slide over its entire range of motion. At one extreme, as indicated in FIG. 7(*a*), locking teeth 70 are completely disengaged from gear teeth 60, allowing main body to rotate freely. At the opposite extreme, as indicated in FIG. 7(*c*), locking teeth 70 and gear teeth 60 are fully engaged, preventing rotation in main body 10.

Block 65 further comprises a cylindrical tab 95 protruding from its bottom surface, as defined when the apparatus is oriented for use. In the preferred embodiment, tab 95 is approximately one-eighth inch in diameter and one eighth inch tall. Tab 95 is oriented along the longitudinal axis of block 65. Tab 65 engages an elongate slot 100 in main body 10. Slot 100 has its longitudinal axis parallel with the direction of linear travel of block 65. Slot 100 is slightly longer than the maximum distance of travel of block 65, such that, when block 65 is at positioned in either extreme position, block 65 is either in contact with one extreme end of slot 100 or in the proximity thereof.

To aid in maintaining the apparatus in the locked position, the invention further comprises a spring 105. In the preferred embodiment, spring 105 is a wire bent out of its residual orientation and held against the outer surface of tab 95. The residual forces in spring 105 tend to force tab 95 and thus block 65 inward against gear teeth 60. Different spring designs can be utilized to perform this function.

Although a limited number of embodiments of the invention have been illustrated and described, various alternatives, modifications and equivalents may be used. Therefore, the foregoing description should not be taken as limiting the scope of the inventions which are defined by the appended claims.

What is claimed is:

1. A snowboard boot binding comprising:

a main body having an upper cavity and a lower cavity, said main body forming a binding in which a boot can be firmly held, said upper cavity and said lower cavity having circular cross-sections and a common radial axis;

a base disc engaging said main body at said lower cavity, the shape of said base disc being complementary to the shape of said lower cavity;

a top disc engaging said main body at said upper cavity, the shape of said top disc being complementary to the shape of said upper cavity;

a fastening means for rigidly attaching said base disc to a snowboard; and a locking means for releasably interlocking said main body with said base disc whereby said main body is prevented from rotating with respect to said base disc.

2. A snowboard boot binding according to claim 1 wherein said locking means comprises:

a plurality of orifices arranged about the perimeter of said base disc;

a horizontal channel in said main body having a cross-sectional shape substantially the same as that of said orifices, said horizontal channel extending from a point adjacent to said base disc to a point external to said main body;

a horizontal shaft having a cross-sectional shape complementary with the cross-sectional shape of said horizontal channel, said horizontal shaft having a first end terminating within said horizontal channel and a second end terminating at a second hinged coupling; and a lever linked to said second hinged coupling, said lever having a first cam whereby angular rotation of said lever moves said horizontal shaft into one of said orifices, preventing said main body from rotating with respect to said base disc.

3. A snowboard boot binding according to claim 1 wherein said locking means comprises:

a plurality of gear teeth arranged about the perimeter of said base disc;

a sliding block adjacent to said base disc and guided by a channel within said main body, said channel having its longitudinal axis oriented radially with respect to said base disc, said block comprising a plurality of locking teeth on the extreme end closest to said base disc whereby said locking teeth and said gear teeth engage when said block is slid against said base disc;

a substantially cylindrical bore within said sliding block, said bore having a radial axis normal to the surface of said snowboard;

a second cam positioned within said bore, said second cam having an axis of operational rotation parallel to the radial axis of said bore and a maximum diameter slightly smaller than the diameter of said bore whereby rotation of said second cam causes said block to reciprocate within said channel; and a lever external to said boot binding and rigidly attached to said cam by a vertical shaft whereby rotation of said lever causes engagement or disengagement between said locking teeth and said gear teeth.

4. A snowboard boot binding comprising:

a main body having an upper cavity and a lower cavity, said main body forming a binding in which a boot can be firmly held, said upper cavity and said lower cavity having circular cross-sections a common radial axis;

a base disc engaging said main body at said lower cavity, the shape of said base disc being complementary to the shape of said lower cavity, said base disc having a plurality of orifices about its perimeter;

a top disc engaging said main body at said upper cavity, the shape of said top disc being complementary to the shape of said upper cavity;

a fastening means for rigidly attaching said base disc to a snowboard;

a horizontal channel in said main body having a cross-sectional shape equal to that of said orifices, said horizontal channel extending from a point adjacent to said base disc to a point external to said main body;

a horizontal shaft having a cross-sectional shape complementary with the cross-section of said horizontal channel, said horizontal shaft having a first end terminating within said horizontal channel and a second end terminating in a second hinged coupling; and a lever linked to said second hinged coupling, said first side lever having a first cam whereby angular rotation of said lever moves said horizontal shaft into one of said orifices, preventing said main body from rotating with respect to said base disc.

5. A snowboard boot binding according to claim 4 wherein said horizontal shaft is metallic.

6. A snowboard boot binding according to claim 4 wherein said horizontal shaft has a circular cross-section.

7. A snowboard boot binding according to claim 4 wherein said horizontal shaft has an oval cross-section.

8. A snowboard boot binding according to claim 4 wherein said orifices are arranged about the perimeter of said top disc.

9. A snowboard boot binding according to claim 4 wherein said wherein said top disc, said main body and said base disc are plastic.

10. A snowboard boot binding comprising:

a main body having an upper cavity and a lower cavity, said main body forming a binding in which a boot can be firmly held, said upper cavity and said lower cavity having circular cross-sections a common radial axis;

a base disc engaging said main body at said lower cavity, the shape of said base disc being complementary to the shape of said lower cavity, said base disc having a plurality of gear teeth about its perimeter;

a top disc engaging said main body at said upper cavity, the shape of said top disc being complementary to the shape of said upper cavity;

a fastening means for rigidly attaching said base disc to a snowboard;

a sliding block adjacent to said base disc and guided by a channel within said main body, said channel having its longitudinal axis oriented radially with respect to said base disc, said block comprising a plurality of locking teeth on the extreme end closest to said base disc whereby said locking teeth and said gear teeth engage when said block is slid against said base disc;

a substantially cylindrical bore within said sliding block, said bore having a radial axis normal to the surface of said snowboard;

a second cam positioned within said bore, said second cam having an axis of operational rotation parallel to the radial axis of said bore and a maximum diameter slightly smaller than the diameter of said bore whereby rotation of said second cam causes said block to reciprocate within said channel; and a lever external to said boot binding and rigidly attached to said cam by a vertical shaft whereby rotation of said lever causes engagement or disengagement between said locking teeth and said gear teeth.

11. A snowboard boot binding according to claim 10 wherein said gear teeth are arranged about the circumference of said top disc.

12. A snowboard boot binding according to claim 10 wherein said wherein said top disc, said main body and said base disc are plastic.

13. A snowboard boot binding according to claim 10 further comprising a tab protruding from the bottom of said block and a corresponding slot in said main body, said slot being elongated whereby reciprocal movement of said block causes said tab to move from one extreme end of said slot to the other extreme end.

14. A snowboard boot binding according to claim 13 further comprising a spring with a first end rigidly attached to said main body and a second end resting against the outermost surface of said tab whereby the residual force of said spring is exerted on said block forcing it against said base disc.

* * * * *